US007318491B2

(12) United States Patent
Riel

(10) Patent No.: US 7,318,491 B2
(45) Date of Patent: Jan. 15, 2008

(54) APPARATUS AND METHOD FOR MODIFIED HORIZONTAL DIRECTIONAL DRILLING ASSEMBLY

(75) Inventor: William G. Riel, Wooster, OH (US)

(73) Assignee: Astec Industries, Inc., Chattanooga, TN (US)

( * ) Notice: Subject to any disclaimer, the term of this patent is extended or adjusted under 35 U.S.C. 154(b) by 208 days.

(21) Appl. No.: 11/116,490

(22) Filed: Apr. 28, 2005

(65) Prior Publication Data

US 2006/0243490 A1 Nov. 2, 2006

(51) Int. Cl.
*E21B 15/04* (2006.01)

(52) U.S. Cl. ..... 175/62; 175/203; 173/1; 173/32; 173/42; 173/44; 173/152

(58) Field of Classification Search ..... 175/62, 175/162, 202, 203; 173/28, 185, 186–189, 173/1, 32, 42, 44, 152
See application file for complete search history.

(56) References Cited

U.S. PATENT DOCUMENTS 3,965,628 A * 6/1976 Loftis ..... 52/115
5,794,723 A * 8/1998 Caneer et al. ..... 175/85
2005/0067168 A1* 3/2005 Baird ..... 166/380

* cited by examiner

*Primary Examiner*—David Bagnell
*Assistant Examiner*—David Andrews
(74) *Attorney, Agent, or Firm*—Chambliss, Bahner & Stophel, P.C.

(57) ABSTRACT

An apparatus and method for a modified horizontal directional drilling assembly for drilling pipe into a drilling surface. The drilling assembly comprises a power unit for supplying power to the assembly, a thrust frame adapted to be moved between a position substantially parallel to the drilling surface and a position substantially perpendicular to the drilling surface and a means for moving the thrust frame. The drilling assembly further comprises a rotary and carriage assembly mounted on the thrust frame. The rotary and carriage assembly is adapted to apply rotational, thrust and pull-back forces to the drill pipe. The drilling assembly is adapted to drill pipe into the drilling surface at any angle relative to the drilling surface between substantially parallel to the drilling surface and substantially perpendicular to the drilling surface. The method includes the steps of placing a drill pipe onto the drilling assembly, moving the thrust frame to a desired drilling angle, moving the rotary and carriage assembly into direct contact with the drill pipe, applying rotational, thrust and pull-back forces to the drill pipe, and drilling the pipe into the drilling surface.

21 Claims, 13 Drawing Sheets

APPARATUS AND METHOD FOR MODIFIED HORIZONTAL DIRECTIONAL DRILLING ASSEMBLY

FIELD OF THE INVENTION

This invention relates generally to assemblies and methods for subsurface drilling, and particularly to assemblies and methods for horizontal directional and vertical subsurface drilling.

BACKGROUND AND DESCRIPTION OF THE PRIOR ART

It is known to use a vertical drilling rig in oil, gas and coal bed methane well drilling. Conventional vertical drilling rigs use heavy drill pipe or drill collars in order to exert downward force on the drill bit as it enters the earth's surface and begins the well bore. As the drill bit of the conventional vertical drilling rig drills deeper below the earth's surface, it is sometimes necessary to apply force in the opposite direction of the drilling direction (pull-back force) in order to prevent placing too much weight on the drill bit and causing damage to or failure of the drill bit.

It is also known to drill oil, gas and methane wells in a vertical direction initially and then deviate or turn the well bore in increments toward a horizontal direction as the drill bit reaches the target formation. The bore hole is then continued in the horizontal direction for a distance. This method exposes a greater volume of the oil, gas and methane producing formation to the well bore and produces a higher and longer producing well. In order to covert a vertical drilling rig to accomplish the combination vertical-horizontal drilling, it is necessary to retrofit the vertical drilling rig with a top drive adapted to fit into the derrick structure and provide rotational force to the drill pipe, rather than just a rotary table and Kelly bar. Conventionally, a rotary table is fixed to the drill rig floor or base such that it does not move up and down with the drill pipe. A heavy fluted round piece of drill pipe called a Kelly bar slides through the rotary table opening and connects to the drill pipe or casing. The keys that engage with the Kelly bar impart the torque to the drill pipe string and permit the Kelly bar to raise and lower through the rotary table opening. The top drive also provides thrust and pull-back forces which are needed while drilling in the horizontal direction. However, the distances of the horizontal runs produced by conventional devices and methods are limited by the capability of the top drive to apply thrust and pull-back forces to the drill pipe. The diameters of the horizontal runs are also limited by the ability to apply thrust and pull-back forces to the drill pipe.

It is also known to use a variation of the vertical-horizontal drilling method described above which is called slant drilling. In slant drilling, a vertical oil, gas, methane drilling rig is retrofitted such that the derrick is disposed at an angle, e.g., 45° to 60° from horizontal. A top drive applies the rotational, thrust and pull-back forces to the drill pipe. It is further known to use drilling rigs commonly known as super singles for subsurface drilling applications relating to oil, gas and methane. Super single drilling rigs utilize longer Range III drill pipe lengths which are 45 feet in length. Super single drilling rigs, therefore, reduce the number of tool joint connections that are required to be made during a subsurface drilling operation. Consequently, the drilling process can be completed more quickly. Super singles utilize a top drive to rotate the drill pipe, to provide the thrust needed for the drill bit to cut and to control the steering of the cutting assembly. Conventional super singles include top drive units having limited thrust capacity and limited rotary torque capacity. Thus, the horizontal distances and bore hole diameter that may be achieved using a super single are limited.

Still further, conventional drilling rigs include power units that are separate from the drilling apparatus and therefore require multiple truckloads to transport the drill rig. Conventional oil, gas and methane drilling assemblies are not anchored to the ground so as to increase performance specifications. Instead, conventional drilling rigs use their own weight to control the machine performance specifications. As a result, convention drilling machines are very heavy and require multiple truckloads to transport. Conventional oil, gas and methane drilling rigs also use heavy weighted drill collars in the drill pipe string in order to provide the thrust force to the drill pipe and a winch and cable system to provide the pull-back force. Weighted drill collars, however, are not effective in the horizontal direction. Some conventional oil, gas and methane drilling rigs use hydraulic cylinders to provide the trust and pull-back forces. Further, conventional oil, gas and methane machines frequently damage the threaded end of a drill string section when the top drive or rotary table engages the threaded end of the drill string section.

Still further, conventional drilling assemblies do not include a roller drill pipe guide bushing assembly adapted to reduce the wear and damage to the drill pipe string. Conventional drilling assemblies do not include automated drill pipe slips adapted to reduce the amount of time required to perform make-up and break-out operations on the drill pipe and/or casing tool joints. Conventional drilling assemblies do not include pipe handling arms adapted to be pinned to the sub-structure for easy removal during transport. Conventional drilling assemblies do not include a positive rack and pinion carriage (top drive) system which is adapted to provide thrust and pull-back forces to the drill pipe string and eliminate the need for cables, winches, hydraulic cylinders, chain systems and the like to provide such forces. Conventional drilling assemblies also do not include a slip spindle sub assembly which is incorporated into the top drive system and adapted to reduce damage and wear to the drill pipe or casing thread.

It would be desirable therefore, if a drilling assembly could be provided that would produce an increased capacity for drill pipe rotational, thrust and pull-back forces. It would also be desirable if a drilling assembly could be provided that would produce longer well bores and well bores having a greater diameter than those produced by conventional drilling assemblies. It would also be desirable if a drilling assembly could be provided that would be capable of entering the earth and drilling a well bore at an angle steeper than conventional horizontal directional drill assemblies. It would also be desirable if a drilling assembly could be provided that would be capable of entering the earth and drilling a well bore at an angle closer to horizontal than conventional vertical drill assemblies. It would also be desirable if a drilling assembly could be provided that would eliminate the need for heavy drill pipe or drill collars to exert downward force on the drill bit. It would also be desirable if a drilling assembly could be provided that would be more easily transported. It would also be desirable if a drilling assembly could be provided that is adapted to be anchored to the ground so as to increase performance specifications. It would also be desirable if a drilling assembly could be provided that would eliminate the need for cables, winches, hydraulic cylinders, chain systems and the like to provide rotational, thrust and pull-back forces. It would be desirable if a drilling assembly could be provided that would reduce the damage and wear to the threaded end of a drill string section when the top drive or rotary table engages the threaded end of the drill string section. It would be desirable if a drilling assembly could be provided that would reduce the amount of time required to perform make-up and break-out operations on the drill pipe and/or casing tool joints. It would be desirable if a drilling assembly could be provided that includes pipe handling arms adapted to be pinned to the sub-structure for easy removal during transport. It would be desirable if a drilling assembly could be provided that is adapted to perform vertical and horizontal drilling applications with a tube-in-tube drill string. It would also be desirable if a drilling assembly could be provided that would be adapted to continue operations in the event of a power unit failure.

ADVANTAGES OF THE INVENTION

Among the advantages of the invention is to provide a drilling assembly that produces an increased capacity for drill pipe rotational, thrust and pull-back forces. It is also an advantage of the invention to provide a drilling assembly that is capable of producing longer well bores and well bores having a greater diameter than those produced by conventional drilling assemblies. It another advantage of the invention to provide a drilling assembly that is capable of entering the earth and drilling a well bore at an angle steeper than conventional horizontal directional drill assemblies. It is still another advantage of the invention to provide a drilling assembly that is capable of entering the earth and drilling a well bore at an angle closer to horizontal than conventional vertical drill assemblies. It is yet another advantage of the invention to provide a drilling assembly that eliminates the need for heavy drill pipe or drill collars to exert downward force on the drill bit. It is a further advantage of the invention to provide a drilling assembly that is more easily transported. It is a still further advantage of the invention to provide a drilling assembly that may be anchored to the ground so as to increase performance specifications. It is also an advantage of the invention to provide a drilling assembly that eliminates the need for cables, winches, hydraulic cylinders, chain systems and the like to provide rotational, thrust and pull-back forces. It is also an advantage of the invention to provide a drilling assembly that reduces the damage and wear to the threaded end of a drill string section when the top drive or rotary table engages the threaded end of the drill string section. It another advantage of the invention to provide a drilling assembly that reduces the amount of time required to perform make-up and break-out operations on the drill pipe and/or casing tool joints. It is a further advantage of the invention to provide a drilling assembly that includes pipe handling arms adapted to be pinned to the sub-structure for easy removal during transport. It is a still further advantage of the invention to provide a drilling assembly that is adapted to perform vertical and horizontal drilling applications with a tube-in-tube drill pipe or a tube-in-tube drill pipe string. It is another advantage of the invention to provide a drilling assembly that may be continuously operated in the event of a power unit failure.

Additional advantages of this invention will become apparent from an examination of the drawings and the ensuing description.

EXPLANATION OF TECHNICAL TERMS

As used herein, the term "drilling a drill pipe into a drilling surface" includes drilling a bore hole into which a drill pipe or a drill pipe string is pulled. The term "drilling a drill pipe into a drilling surface" also includes pulling the drill pipe or the drill pipe string out of the bore hole.

As used herein, the term "drilling surface" includes the Earth's subsurface strata and any other medium into which a bore hole may be drilled.

As used herein, the term "hydraulic actuator" includes hydraulic cylinders, hydraulic rotary actuators, pneumatic cylinders and any other device or system in which pressurized fluid is used to impart a mechanical force.

As used herein, the term "tube-in-tube" refers to a type of drill pipe or drill pipe string characterized by an outer drill pipe wall and a substantially axially positioned inner drill pipe wall that is substantially surrounded by the outer drill pipe wall.

SUMMARY OF THE INVENTION

The apparatus claimed herein comprises a modified horizontal directional drilling assembly for drilling pipe into a drilling surface. The drilling assembly comprises a power unit for supplying power to the assembly, a thrust frame adapted to be moved between a position substantially parallel to the drilling surface and a position substantially perpendicular to the drilling surface and a means for moving the thrust frame. The drilling assembly further comprises a rotary and carriage assembly mounted on the thrust frame. The rotary and carriage assembly is adapted to apply rotational, thrust and pull-back forces to the drill pipe. The drilling assembly is adapted to drill pipe into the drilling surface at any angle relative to the drilling surface between substantially parallel to the drilling surface and substantially perpendicular to the drilling surface.

The method for drilling pipe into a drilling surface claimed herein comprises providing a modified horizontal directional drilling assembly. The drilling assembly comprises a power unit for supplying power to the assembly, a thrust frame adapted to be moved between a position substantially parallel to the drilling surface and a position substantially perpendicular to the drilling surface, a means for moving the thrust frame, and a rotary and carriage assembly mounted on the thrust frame. The rotary and carriage assembly is adapted to apply rotational, thrust and pull-back forces to the drill pipe. The drilling assembly is adapted to drill pipe into the drilling surface at any angle relative to the drilling surface between substantially parallel to the drilling surface and substantially perpendicular to the drilling surface. The method further comprises placing a drill pipe onto the drilling assembly, moving the thrust frame to a desired drilling angle, moving the rotary and carriage assembly into direct contact with the drill pipe, applying rotational, thrust and pull-back forces to the drill pipe, and drilling the pipe into the drilling surface.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
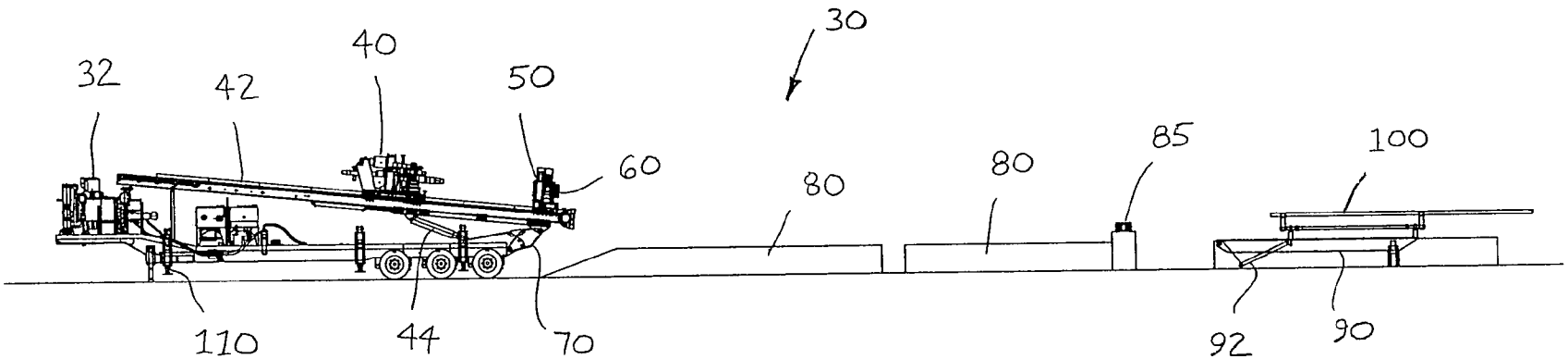
FIG. 1 is a side view of a preferred embodiment of the modified horizontal directional drilling assembly in accordance with the present invention illustrating the drilling assembly in a retracted transport position approaching a drilling site.

Referring now to the drawings, the preferred embodiment of the apparatus and method for the modified horizontal directional drilling assembly of the invention is illustrated in FIGS. 1 through 12. More particularly, as shown in FIGS. 1 through 12, the preferred modified horizontal directional drilling assembly ("modified HDD assembly") is designated generally by reference numeral 30. The preferred modified HDD assembly 30 is adapted for use in both horizontal directional drilling applications and vertical subsurface drilling applications such as oil, gas and methane subsurface drilling.

As shown in FIG. 1, the preferred modified HDD assembly 30 preferably includes a pair of power units 32 and 34 (not shown). The preferred power units are diesel engines, but it is contemplated within the scope of the invention that any suitable power source such as electric motors, diesel engines and generators and the like may be used. A plurality of power units are provided so that drilling operations can continue in the event of the failure of less than all of the power units. More particularly, the preferred HDD assembly 30 comprises two independent power units so that if one of the power units requires repair or maintenance, or if the hydraulic system connected to one of the power units requires repair or maintenance, the assembly can still be operated at full capacity (at half speed) by the other power unit and the drilling operation can continue uninterrupted (run-on-one-technology ("ROOT")). Consequently, the risk of bore hole wall collapse is minimized. The power units are preferably attached to the modified HDD assembly such that they can be transported with the assembly as a single unit. It is contemplated within the scope of the invention, however, that the power units may be removably attached to and transported separate from the other components of the drilling assembly.

Still referring to FIG. 1, the preferred modified HDD assembly 30 also includes rotary and carriage assembly 40. The preferred rotary and carriage assembly 40 is adapted to move along thrust frame 42 and provide thrust force, pull-back force and rotational torque to a drill pipe or casing. The preferred rotary and carriage assembly is a positive rack and pinion carriage system which eliminates the need for cable, winches, hydraulic cylinders, chain systems and the like. The preferred modified HDD assembly further includes breakout wrench assembly 50 and roller-style anti-friction drill pipe guide bushing assembly 60. The preferred breakout wrench assembly 50 is adapted to make-up and breakout the drill pipe tool connections. The preferred bushing assembly 60 is adapted to reduce wear on the drill pipe string.

Figure 3:
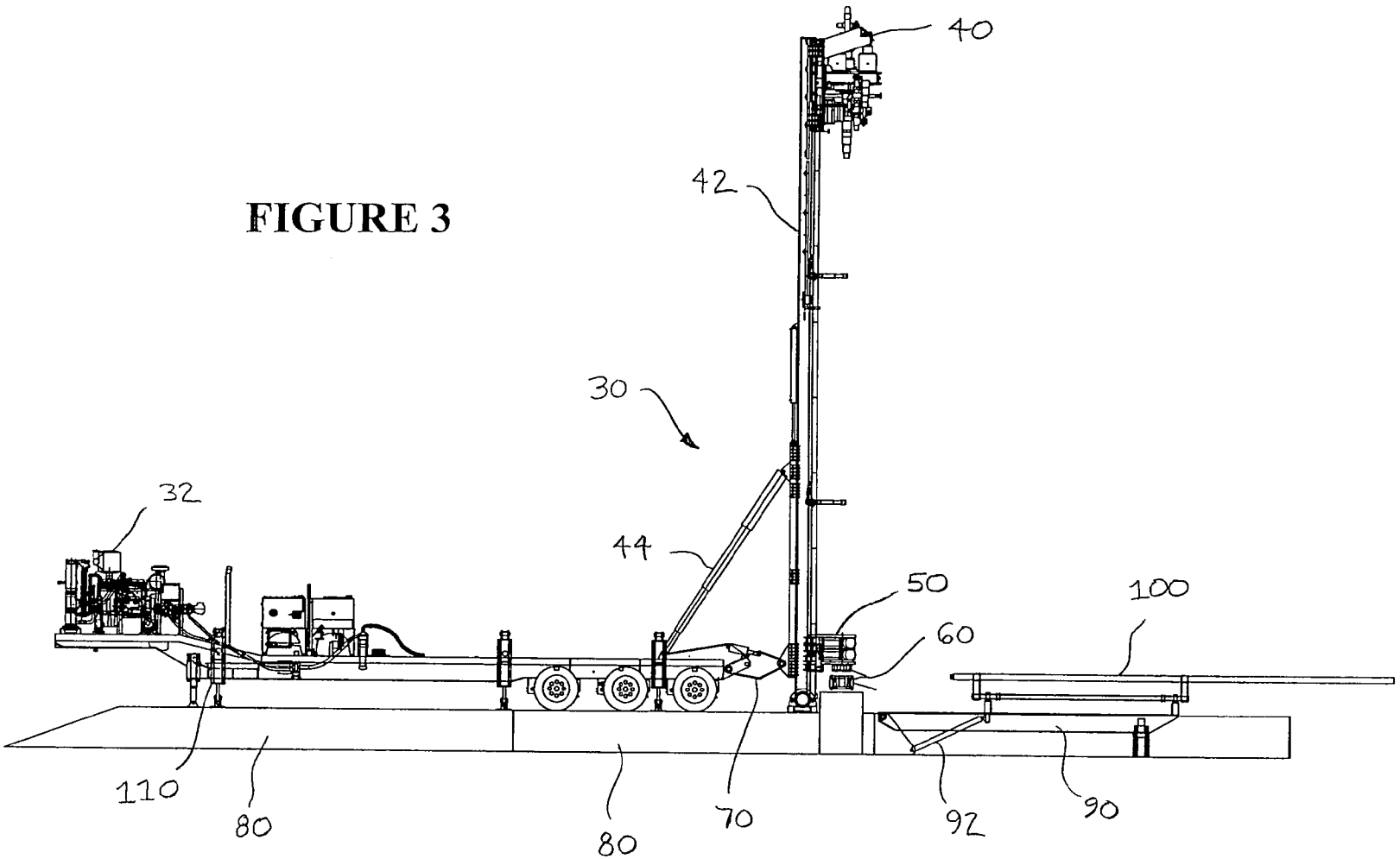
FIG. 3 is a side view of the preferred modified horizontal directional drilling assembly shown in FIGS. 1-2 illustrating the drilling assembly in a vertical subsurface drilling position with the drill pipe in a horizontal stored position.

In addition, the preferred HDD assembly 30 includes a pair of pivoting hinges 70 (see also FIG. 4) which are adapted to permit thrust frame 42 to be pivotally moved between a position approximately parallel to the drilling surface (as shown in FIG. 1) and a position approximately perpendicular to the drilling surface (as shown in FIG. 3). The preferred pivoting hinge 70 is a double hinge arrangement having two pivot points. It is contemplated within the scope of the invention, however, that the pivoting hinge may have less than or more than two pivot points. It is further contemplated within the scope of the invention that less than or more than two pivoting hinges may be used to move thrust frame between a position approximately parallel to the drilling surface and a position approximately perpendicular to the drilling surface.

Figure 4:
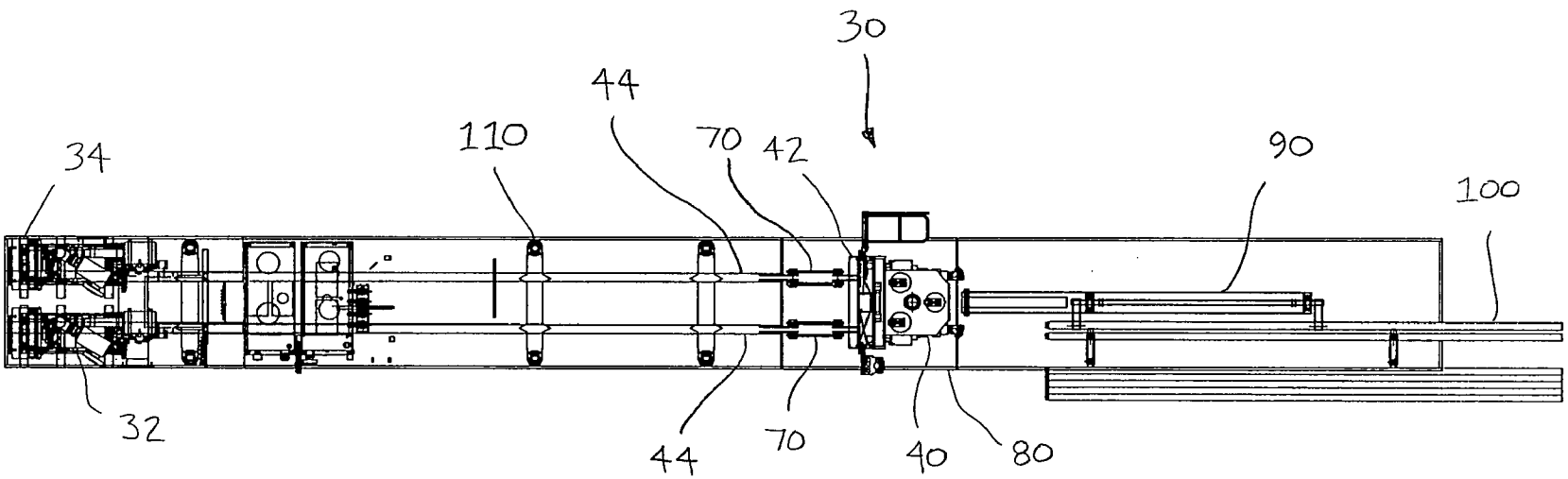
FIG. 4 is a top view of the preferred modified horizontal directional drilling assembly shown in FIG. 3.

Preferably, the rotary and carriage assembly 40 and thrust frame 42 are moved between an approximately horizontal position and an approximately vertical position by frame hydraulic cylinders 44 (see also FIG. 4). It is contemplated within the scope of the invention, however, that any suitable device or assembly may be used to pivotally move the rotary and carriage assembly and the thrust frame between an approximately horizontal position and an approximately vertical position such as a motor and chain assembly, a motor and cable assembly, a motor and gear assembly and the like. It is further contemplated that less than or more than two hydraulic cylinders may be provided to move the rotary and carriage assembly and the thrust frame between an approximately horizontal position and an approximately vertical position. It is still further contemplated that the rotary and carriage assembly and the thrust frame may be moved beyond an approximately vertical position through an approximately 90° arc.

Figure 5:
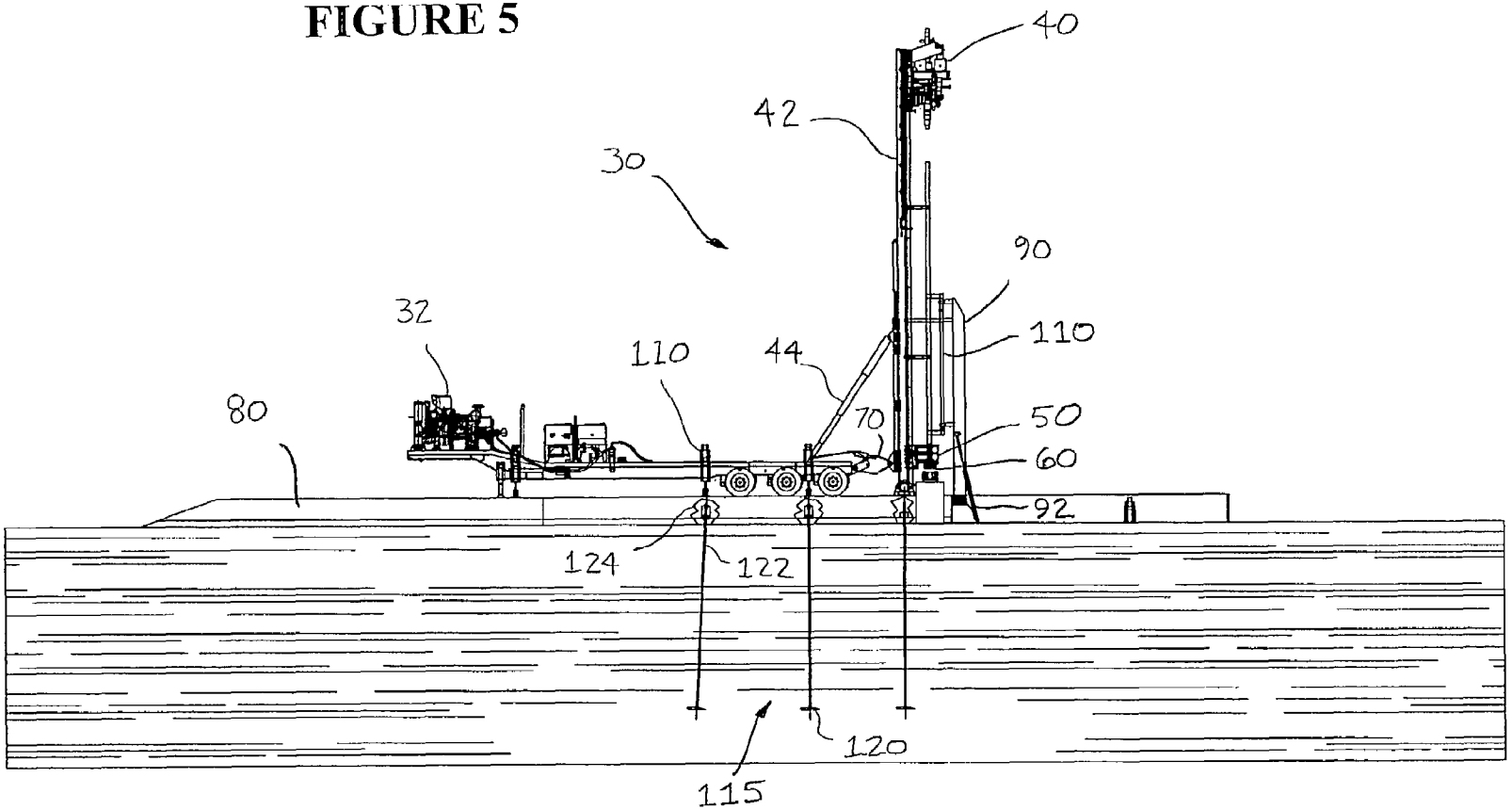
FIG. 5 is a side view of the preferred modified horizontal directional drilling assembly shown in FIGS. 1-4 illustrating the drilling assembly in a vertical subsurface drilling position with the drill pipe in a vertical drilling position and illustrating a preferred anchoring system.

Still referring to FIG. 1, the preferred modified HDD assembly 30 also includes sub-structure 80 which is adapted to raise the assembly to a sufficient height so as to clear a blow-out preventer (BOP). In addition, sub-structure 80 is adapted to anchor the assembly to the ground (as shown in FIG. 5) such that thrust forces in excess of the weight of the assembly and sub-structure may be applied to the drill pipe or casing. The sub-structure illustrated by FIG. 1 is shown in a disassembled condition for transport. The preferred modified HDD assembly 30 further includes remote operated drill pipe or casing slip assembly 85. The preferred slip assembly 85 is adapted to prevent a drill pipe from dropping down into the drill bore. In addition, the preferred slip assembly 85 is adapted to reduce the amount of time required to perform drill pipe and/or casing tool joint make-up and break-out operations. Still further, the preferred slip assembly 85 functions as a safety feature by keeping personnel away from the moving drill pipe and casing.

Figure 7:
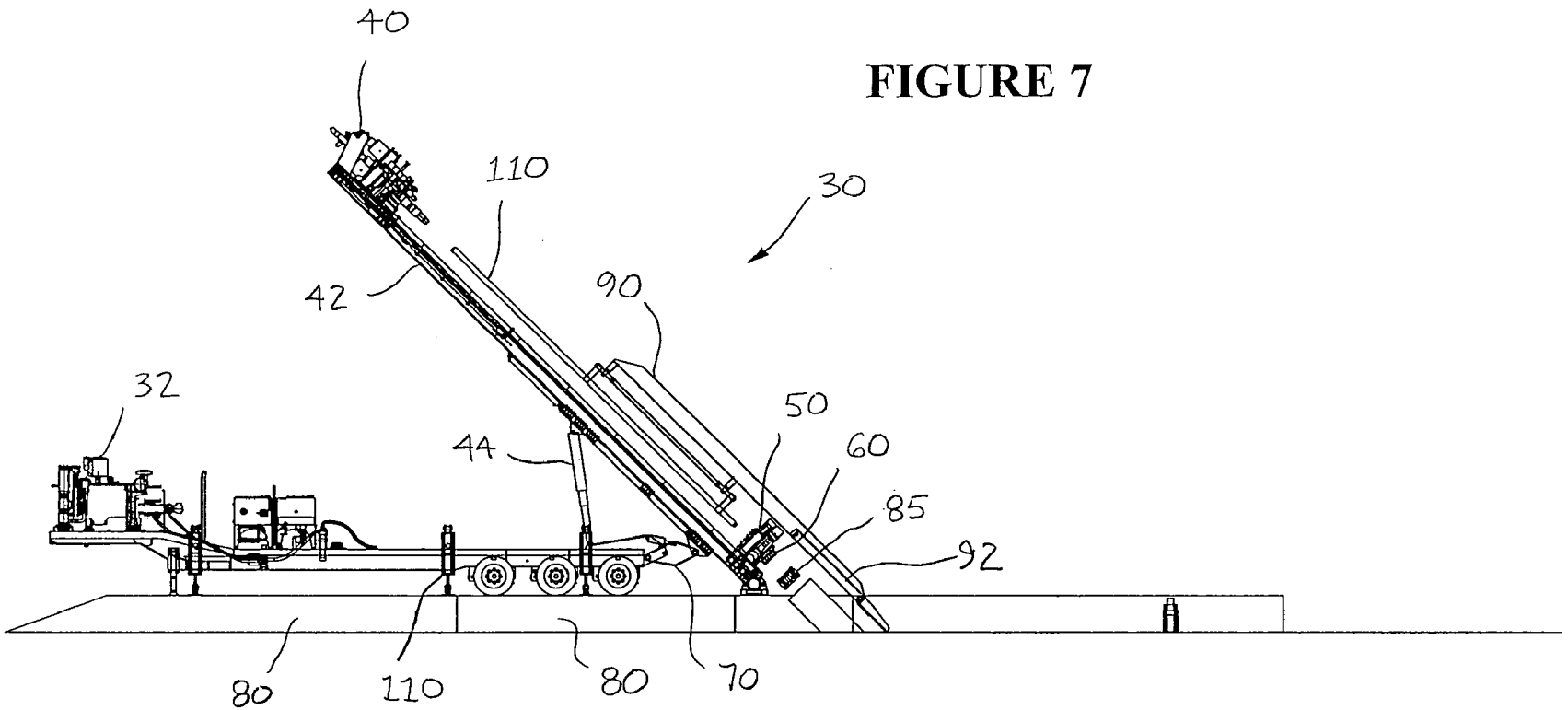
FIG. 7 is a side view of the preferred embodiment of the modified horizontal directional drilling assembly shown in FIGS. 1-6 illustrating the drilling assembly and the drill pipe in a 45° angle slant subsurface drilling position.

Referring still to FIG. 1, drill pipe and casing handler 90 is adapted to pick up drill pipe 100 or casing from an approximately horizontal position substantially parallel to the drilling surface (such as the position in which drill pipes or casings are stored in storage racks). Further, the preferred handler 90 is adapted to pivotally move drill pipe 100 or a casing to an approximately vertical position substantially perpendicular to the drilling surface for vertical subsurface drilling applications. Still further, the preferred handler 90 is adapted to pivotally move drill pipe 100 beyond an approximately vertical position as shown in FIG. 7. In addition, the preferred handler 90 is adapted to hold the drill pipe or casing in position until the rotary and carriage assembly is connected to the drill pipe or casing. The preferred handler 90 is adapted to move the drill pipe or casing into an infinite number of positions from an approximately horizontal stored position to an appropriate position for connection of the drill pipe or casing with the rotary and carriage assembly. The preferred handler 90 is removably connected to sub-structure 80 by one or more pin connections.

Still referring to FIG. 1, handler 90 and drill pipe 100 or a casing are preferably moved from the approximately horizontal stored position to an appropriate position for connection of the drill pipe or casing with the rotary and carriage unit by handler hydraulic cylinder 92. It is contemplated within the scope of the invention, however, that any suitable device or assembly may be used to pivotally move the drill pipe and casing handler between an approximately horizontal stored position and an appropriate position for connection of the drill pipe or casing with the rotary and carriage assembly such as a motor and chain assembly, a motor and cable assembly, a motor and gear assembly, a rotary actuator and the like. It is further contemplated that a plurality of hydraulic cylinders may be provided to move the drill pipe and casing handler between an approximately stored horizontal position and an appropriate position for connection of the drill pipe or casing with the rotary and carriage assembly. The preferred drill pipe 100 is shown in the stored horizontal position. The preferred handler 90 is shown in a condition ready for loading and transport.

Still referring to FIG. 1, the preferred modified HDD assembly 30 further includes a plurality of leveling jacks 110. Leveling jacks 110 are preferably mounted to the assembly and adapted to level the assembly. In addition, the preferred leveling jacks 110 provide stability to modified HDD assembly 30. Further, the preferred leveling jacks 110 are mounted to sub-structure 80 in order to provide additional anchoring forces to the assembly.

Figure 2:
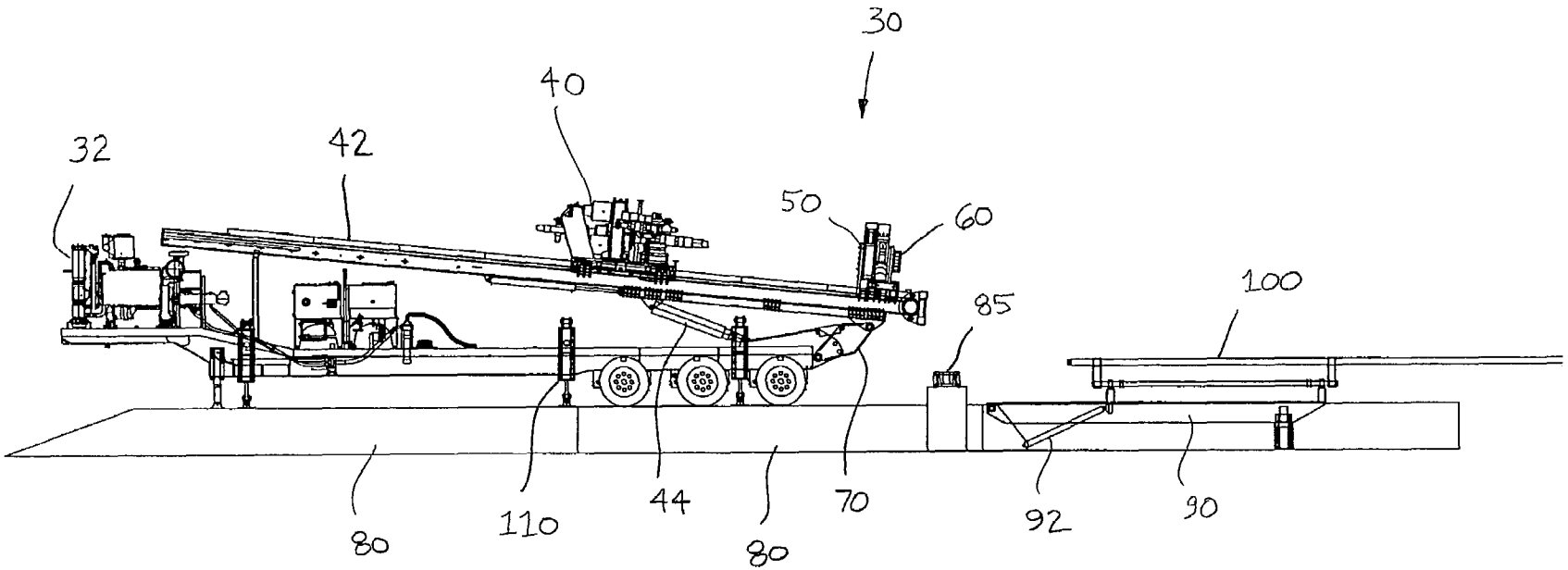
FIG. 2 is a side view of the preferred modified horizontal directional drilling assembly shown in FIG. 1 illustrating the drilling assembly in a retracted transport position on a preferred sub-structure.

Referring now to FIG. 2, a side view of preferred modified HDD assembly 30 is illustrated. More particularly, FIG. 2 illustrates preferred modified HDD assembly 30 in a retracted transport position on preferred sub-structure 80. As shown in FIG. 2, preferred modified HDD assembly 30 includes power unit 32 (power unit 34 not shown), rotary and carriage assembly 40, thrust frame 42, frame hydraulic cylinder 44, breakout wrench assembly 50, bushing assembly 60, pivoting hinge 70, sub-structure 80, slip assembly 85, drill pipe and casing handler 90, handler hydraulic cylinder 92, drill pipe 100 and leveling jacks 110.

Referring now to FIG. 3, a side view of the preferred modified HDD assembly 30 is illustrated. More particularly, FIG. 3 shows the preferred modified HDD assembly 30 in position for a vertical subsurface drilling application. The preferred drill pipe 100 is shown in a horizontal stored position. As shown in FIG. 3, preferred modified HDD assembly 30 includes power unit 32 (power unit 34 not shown), rotary and carriage assembly 40, thrust frame 42, frame hydraulic cylinder 44, breakout wrench assembly 50, bushing assembly 60, pivoting hinge 70, sub-structure 80, slip assembly 85, drill pipe and casing handler 90, handler hydraulic cylinder 92, drill pipe 100 and leveling jacks 110. Further, as shown in FIG. 3, rotary and carriage assembly 40 and thrust frame 42 of preferred modified HDD assembly 30 are adapted to be pivotally rotated from a position approximately parallel to the drilling surface (as shown in FIGS. 1 and 2) to a position approximately perpendicular to the drilling surface in order to perform vertical subsurface drilling applications. Rotary and carriage assembly 40 and thrust frame 42 are preferably moved between an approximately horizontal position and an approximately vertical position by frame hydraulic cylinder 44.

Referring now to FIG. 4, a top view of the preferred modified HDD assembly 30 is illustrated. More particularly, FIG. 4 illustrates preferred modified HDD assembly 30 in the position shown in FIG. 3 with the preferred pivoting hinges 70 in a lowered position. As shown in FIG. 4, modified HDD assembly 30 includes power unit 32, power unit 34, rotary and carriage assembly 40, thrust frame 42, frame hydraulic cylinders 44, pivoting hinges 70, sub-structure 80, drill pipe and casing handler 90, drill pipe 100 and leveling jacks 110.

Referring now to FIG. 5, a side view of the preferred modified HDD assembly 30 is illustrated. More particularly, FIG. 5 illustrates preferred modified HDD assembly 30 in a vertical subsurface drilling application with drill pipe and casing handler 90 and drill pipe 100 in a vertical drilling position. Further, FIG. 5 illustrates the preferred anchoring system 115. As shown in FIG. 5, preferred modified HDD assembly 30 includes power unit 32 (power unit 34 not shown), rotary and carriage assembly 40, thrust frame 42, frame hydraulic cylinder 44, breakout wrench assembly 50, bushing assembly 60, pivoting hinge 70, sub-structure 80, slip assembly 85, drill pipe and casing handler 90, handler hydraulic cylinder 92, drill pipe 100, leveling jacks 110 and tipping plate anchors 120. Further, as shown in FIG. 5, drill pipe and casing handler 90 is adapted to releasable retain and pivotally move drill pipe 100 from a position approximately parallel to the drilling surface (as shown in FIGS. 1-3) to a position approximately perpendicular to the drilling surface. Preferably, drill pipe and casing handler 90 is moved between a position approximately parallel to the drilling surface and a position approximately perpendicular to the drilling surface by handler hydraulic cylinder 92.

Still referring to FIG. 5, the preferred anchoring system 115 includes tipping plate anchors 120 which are adapted to be driven into the ground to the required depth. Anchor rod 122 extends from the tipping plate anchors 120 to the ground surface. Anchor rod 122 may be connected to sub-structure 80 by anchor hydraulic cylinder 124. The preferred anchor hydraulic cylinder 124 is adapted to be set into a socket into the frame of sub-structure 80 such that the cylinder may be pivoted for alignment with the anchor rod. The preferred anchor hydraulic cylinder is also adapted to tip the tipping plate anchor and maintain a pre-determined hydraulic pressure such that the desired anchor rod tensional load will be maintained during drilling operations. In the alternative, anchor rod 122 may be connected to sub-structure 80 using a split tapered bushing which is adapted to lock onto the anchor rod and be inserted into a tapered housing connected to the sub-structure. As the anchor loads are increased, the split tapered bushing fits more tightly in the tapered housing, thereby increasing the anchor rod grip force.

Figure 6:
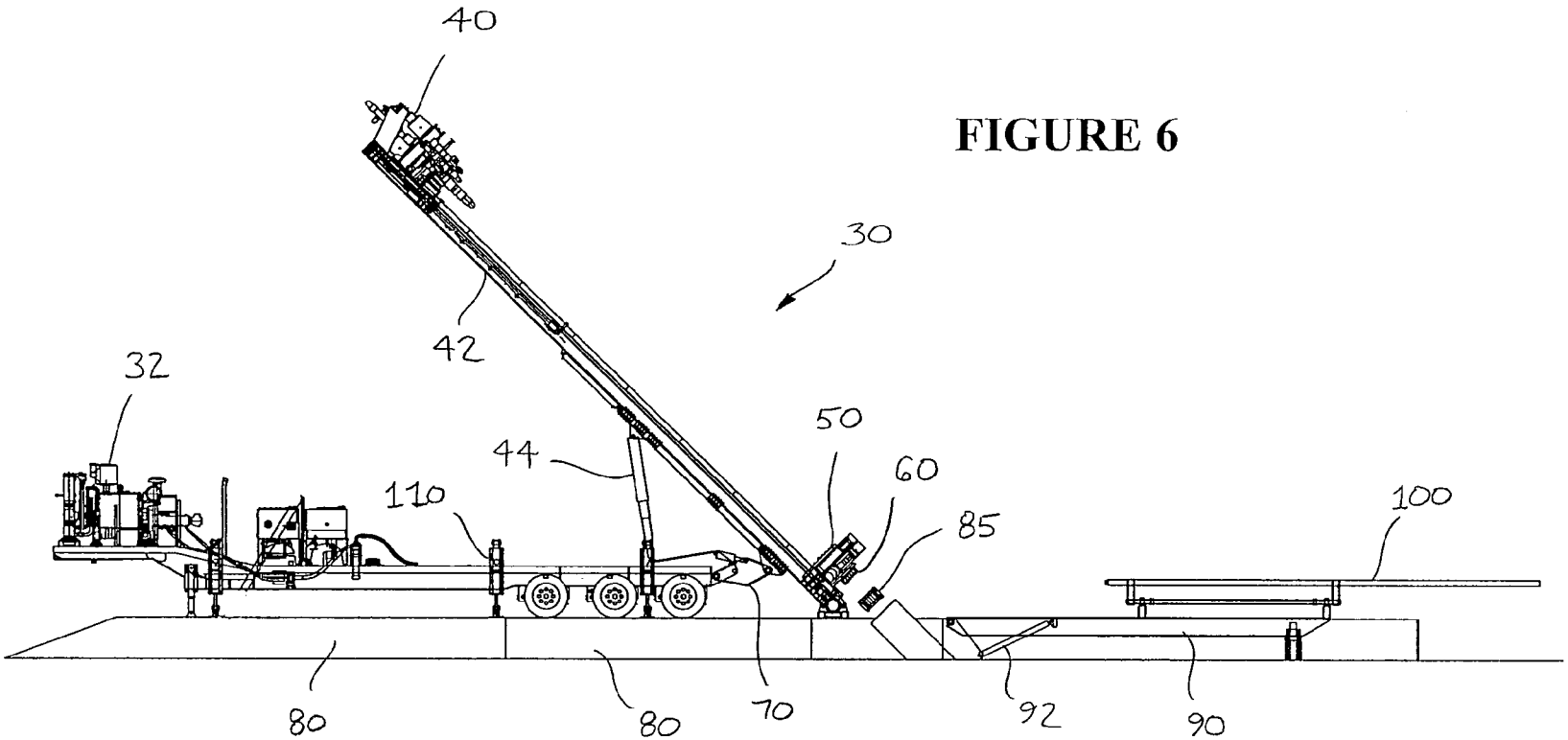
FIG. 6 is a side view of the preferred embodiment of the modified horizontal directional drilling assembly shown in FIGS. 1-5 illustrating the drilling assembly in a 45° angle slant subsurface drilling position with the drill pipe in a horizontal stored position.

Referring now to FIG. 6, a side view of the preferred modified HDD assembly 30 is illustrated. More particularly, FIG. 6 illustrates rotary and carriage assembly 40, thrust frame 42, drill pipe and casing breakout wrench assembly 50, drill pipe guide bushing assembly 60 and slip assembly 85 of preferred modified HDD assembly 30 in a 45° angle slant subsurface drilling position With drill pipe 100 in a horizontal stored position. The preferred pivoting hinge 70 is shown in a lowered position. As shown in FIG. 6, modified HDD assembly 30 includes power unit 32 (power unit 34 not shown), rotary and carriage assembly 40, thrust frame 42, frame hydraulic cylinder 44, breakout wrench assembly 50, bushing assembly 60, pivoting hinge 70, sub-structure 80, slip assembly 85, drill pipe and casing handler 90, handler hydraulic cylinder 92, drill pipe 100 and leveling jacks 110. Further, as shown in FIG. 6, rotary and carriage assembly 40 and thrust frame 42 of preferred modified HDD assembly 30 are adapted to be pivotally rotated from a position approximately parallel to the drilling surface (as shown in FIGS. 1 and 2) to a position. approximately 45° from the horizontal drilling surface in order to perform slant subsurface drilling applications. Rotary and carriage assembly 40 and thrust frame 42 are preferably moved between an approximately horizontal position and a position approximately 45° from the horizontal drilling surface by frame hydraulic cylinder 44.

Referring now to FIG. 7, a side view of the preferred modified HDD assembly 30 is illustrated. More particularly, FIG. 7 illustrates preferred modified HDD assembly 30, rotary and carriage assembly 40, breakout wrench assembly 50, guide bushing assembly 60, slip assembly 85 and preferred drill pipe 100 in a 45° angle slant subsurface drilling position. The preferred pivoting hinge 70 is shown in a lowered position. As shown in FIG. 6, modified HDD assembly 30 includes power unit 32 (power unit 34 not shown), rotary and carriage assembly 40, thrust frame 42, frame hydraulic cylinder 44, breakout wrench assembly 50, bushing assembly 60, pivoting hinge 70, sub-structure 80, slip assembly 85, drill pipe and casing handler 90, handler hydraulic cylinder 92, drill pipe 100 and leveling jacks 110. Further, as shown in FIG. 6, drill pipe and casing handler 90 and drill pipe 100 are adapted to be pivotally rotated from a position approximately parallel to the drilling surface (as shown in FIGS. 1, 2, 3 and 6) to a position approximately 45° from the horizontal drilling surface in order to perform slant subsurface drilling applications. Drill pipe and casing handler 90 and drill pipe 100 are preferably moved between an approximately horizontal position and a position approximately 135° from the horizontal drilling surface by handler hydraulic cylinder 92.

Figure 8:
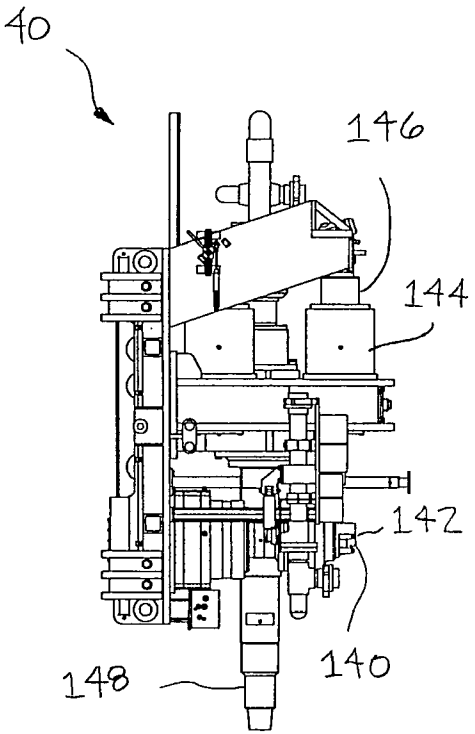
FIG. 8 is a side view of the rotary and carriage assembly of the preferred embodiment of the modified horizontal directional drilling assembly shown in FIGS. 1-7.

Referring now to FIG. 8, a side view of rotary and carriage assembly 40 of the preferred embodiment of modified HDD assembly 30 is illustrated. The preferred rotary and carriage assembly 40 is adapted to apply thrust and pull-back forces to a drill pipe or casing or a string of drill pipes or casings through a combination of pinion drive planetary gearboxes and hydraulic motors. More particularly, as shown in FIG. 8, preferred rotary and carriage assembly 40 includes carriage drive planetary gearboxes 140 and carriage drive motors 142. The preferred rotary and carriage assembly further includes rotary gearbox planetary gearboxes 144, rotary gearbox hydraulic motors 146 and rotary gearbox output spindle 148. The preferred rotary gearbox and the preferred output spindle applies rotational torque to a drill pipe or a string of drill pipes. While FIG. 8 illustrates hydraulic motors adapted to provide a power source to the preferred rotary and carriage assembly, it is contemplated within the scope of the invention that the rotary and carriage assembly may be powered by and suitable power source such as an electric motor and the like.

Figure 9:
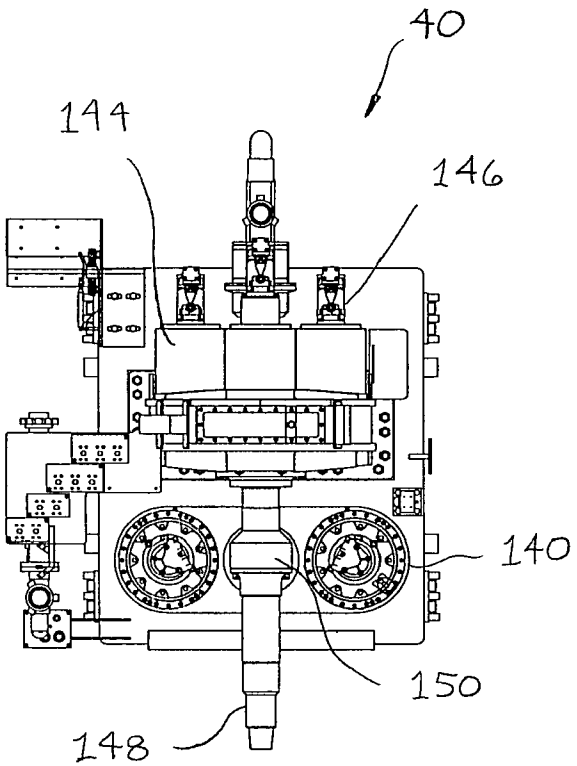
FIG. 9 is a top view of the preferred rotary and carriage-assembly shown in FIGS. 1-8.

Referring now to FIG. 9, a top view of preferred rotary and carriage assembly 40 is illustrated. As shown in FIG. 9, preferred rotary and carriage assembly 40 includes carriage drive planetary gearboxes 140 and carriage drive motors 142. The preferred rotary and carriage assembly further includes rotary gearbox planetary gearboxes 144, rotary gearbox hydraulic motors 146 and rotary gearbox output spindle 148. In addition, preferred rotary and carriage assembly 40 includes telescoping slip spindle sub assembly 150 which is described in more detail below.

Figure 10:
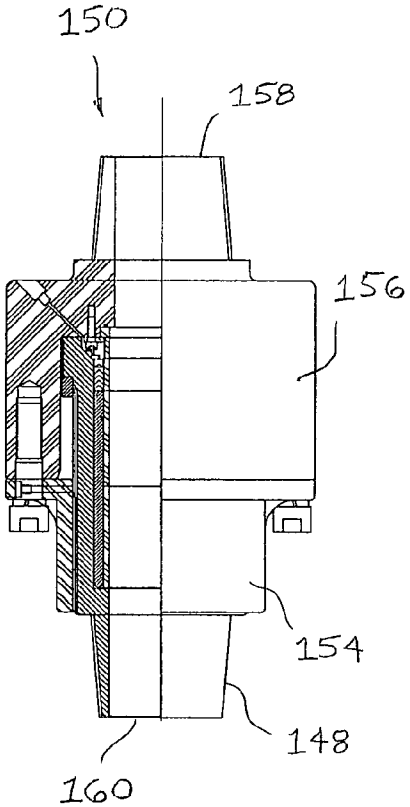
FIG. 10 is a partial sectional side view of the telescoping slip spindle sub assembly of the preferred embodiment of the modified horizontal directional drilling assembly shown in FIGS. 1-9 illustrating the slip spindle sub assembly output spindle in a retracted condition.

Referring now to FIG. 10, a partial sectional side view of the preferred telescoping slip spindle sub assembly 150 of the preferred embodiment of modified HDD assembly 30 is illustrated. More particularly, FIG. 10 illustrates preferred slip spindle sub assembly 150 with output spindle 148 in a retracted condition. As shown in FIG. 10, preferred slip spindle sub assembly 150 includes output spindle 148, drive sleeve 154 and housing 156. The preferred output spindle 148 is adapted to extend and retract in a telescoping manner depending upon the direction of the thrust loading applied to the rotary and carriage assembly. Preferably, the output spindle axially extends from and axially retracts into housing 156 a distance of approximately four inches. The preferred drive sleeve 154 engages preferred output spindle 148 so as to transmit rotational torque from slip spindle input end 158 to slip spindle output end 160. The preferred slip spindle sub assembly reduces damage and wear to the drill pipe and casing thread extends the life of drill pipe tool joint connections threads as a result of the telescoping action of output spindle 148.

Figure 11:
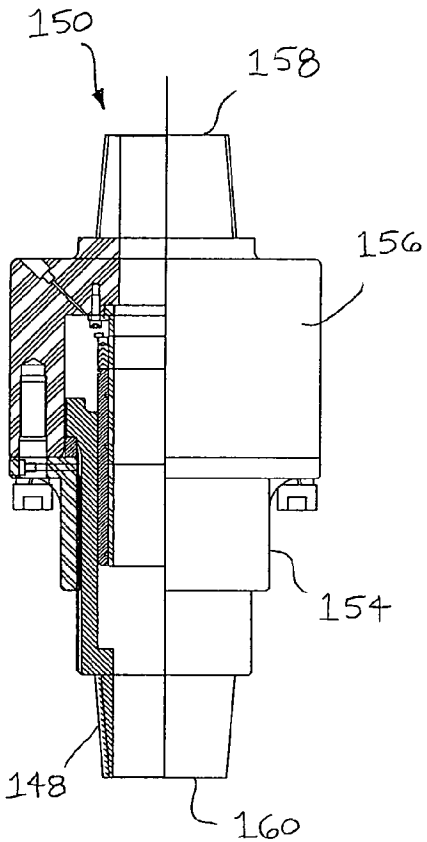
FIG. 11 is a partial sectional side view of the telescoping slip spindle sub assembly of the preferred embodiment of the modified horizontal directional drilling assembly shown in FIGS. 1-10 illustrating the slip spindle sub assembly output spindle in an extended condition.

Referring now to FIG. 11, a partial sectional side view of the preferred telescoping slip spindle sub assembly 150 of the preferred embodiment of modified HDD assembly 30 is illustrated. More particularly, FIG. 11 illustrates preferred slip spindle sub assembly 150 with output spindle 148 in an extended condition. As shown in FIG. 11, preferred slip spindle sub assembly 150 includes output spindle 148, drive sleeve 154, housing 156, input end 158 and output end 160.

Figure 12:
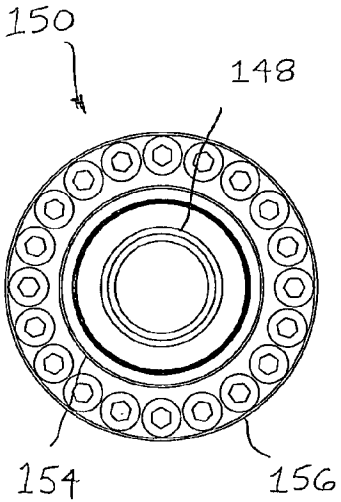
FIG. 12 is an end view of the telescoping slip spindle sub assembly of the preferred embodiment of the modified horizontal directional drilling assembly shown in FIGS. 1-11.

Referring now to FIG. 12, a cross-sectional view of the preferred telescoping slip spindle sub assembly 150 of the preferred embodiment of modified HDD assembly 30 is illustrated. More particularly, as shown in FIG. 12, preferred slip spindle sub assembly 150 includes output spindle 148, drive sleeve 154 and housing 156.

Figure 13:
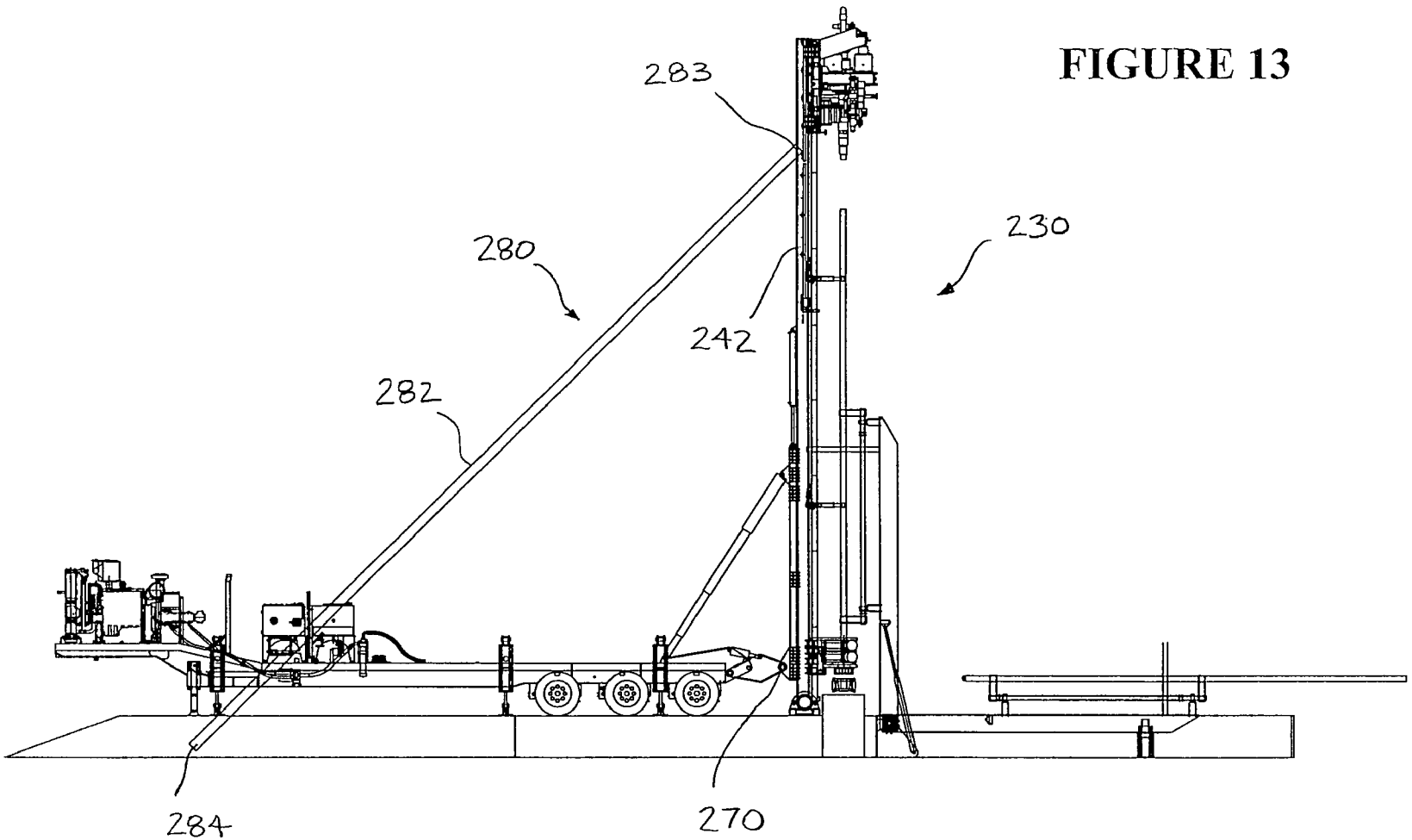
FIG. 13 is a side view of a first alternative embodiment of the modified horizontal directional drilling assembly of the present invention illustrating the fixed pivot and the wide strut system.

Referring now to FIG. 13, a side view of a first alternative embodiment of the modified horizontal directional drilling assembly is illustrated. More particularly, the preferred modified horizontal directional drilling assembly 230 includes fixed pivot 270 and wide strut system 280. The preferred fixed pivot 270 is adapted to permit thrust frame 242 to be pivotally moved between a position that is substantially parallel to the drilling surface and a position that is substantially perpendicular to the drilling surface. Preferably, fixed pivot 270 is adapted to permit thrust frame 242 to be moved through an approximately 90° angle.

Figure 14:
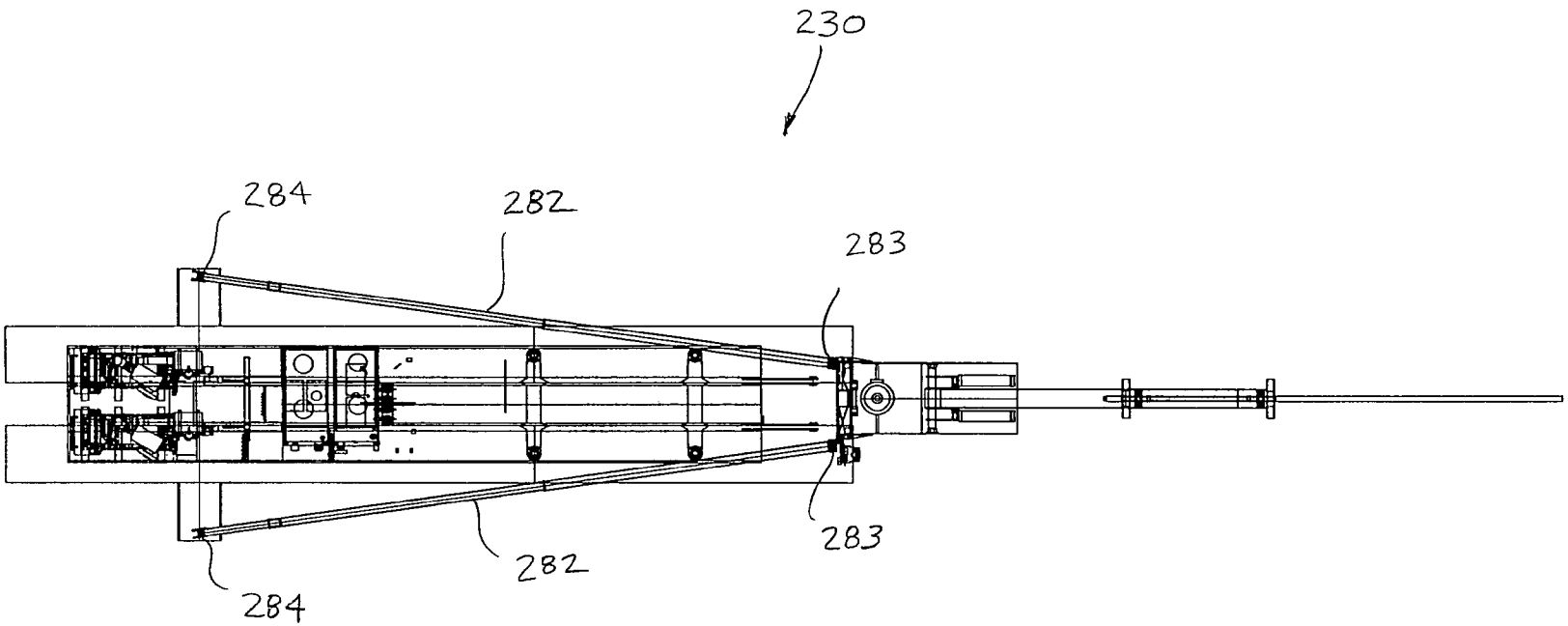
FIG. 14 is a top view of the first alternative embodiment of the modified horizontal directional drilling assembly illustrated in FIG. 13.

Referring now to FIGS. 13 and 14, the preferred wide strut system 280 is adapted to provide stability to the drilling assembly. The preferred wide strut system includes a pair of wide strut system arms 282, each of which have a thrust frame end 283 attached to thrust frame 242 and an. anchoring end 284 adapted to be anchored to sub-structure 280. While the wide strut system illustrated in FIGS. 13 and 14 includes a pair of arms, it is contemplated within the scope of the invention that the wide strut system may include more or less than two arms. It is also contemplated within the scope of the invention that the anchoring end of the arms may be anchored to any suitable support structure, including but not limited to, the drilling surface. Further, although the wide strut system illustrated in FIGS. 13 and 14 shows the thrust frame in a substantially vertical position, it is contemplated within the scope of the invention that the wide strut system may be adapted for use when the thrust frame is not in a substantially vertical position.

Figure 15:
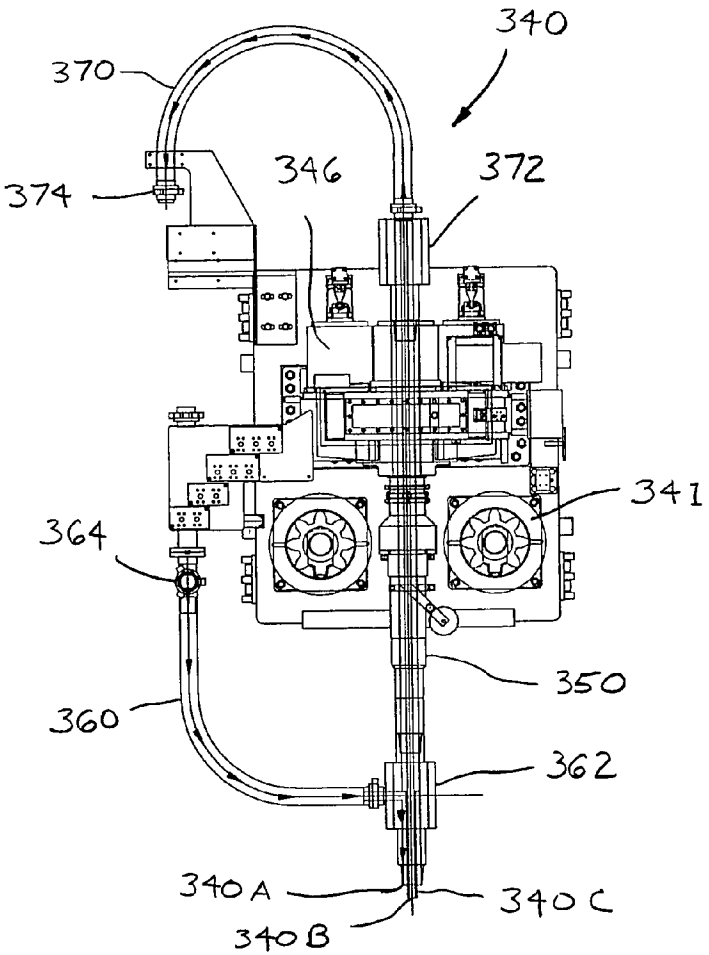
FIG. 15 is a top view of an alternative embodiment of the rotary and carriage assembly of the preferred modified horizontal directional drilling assembly of the present invention.
Figure 15A:
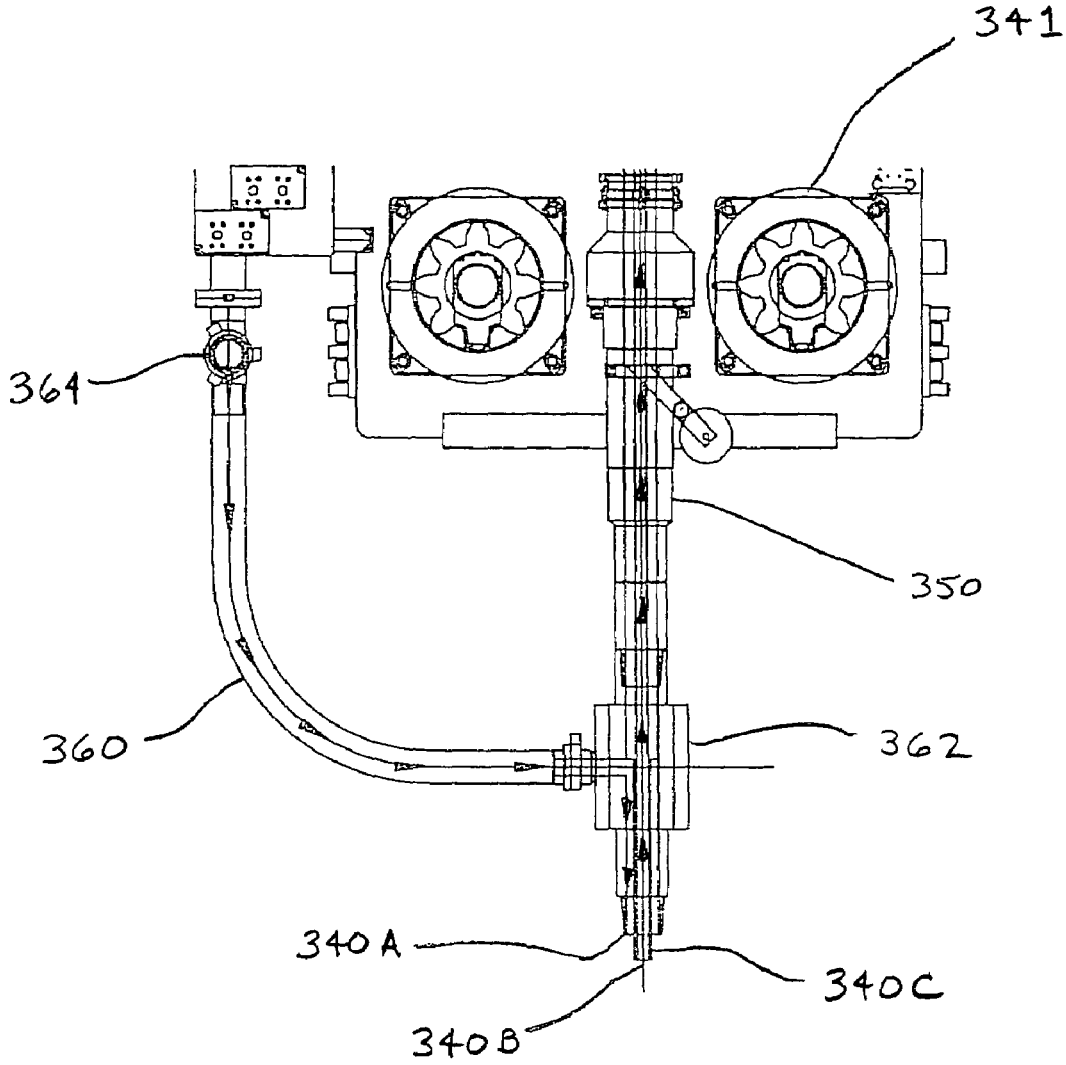
FIG. 15A is an enlarged view of the lower portion of the preferred rotary and carriage assembly illustrated in FIG. 15.

Referring now to FIG. 15, a top view of an alternative embodiment of the rotary and carriage assembly of the preferred modified horizontal directional drilling assembly of the present invention is illustrated. The preferred rotary and carriage assembly is designated generally by reference numeral 340. The preferred rotary and carriage assembly 340 is adapted to for use in connection with tube-in-tube drill pipes and tube-in-tube drill pipe strings. More particularly, the preferred rotary and carriage assembly 340 is adapted to pump fluid (such as bentonite, air, water and the like) through the annular channel located between the inner tube and the outer tube of a tube-in-tube drill pipe toward the cutting tool (such as a percussion hammer) of the drill pipe string. In such a tube-in-tube drill pipe application, the fluid pumped through the annular channel of the drill pipe actuates the cutting tool, removes cuttings from the face of the cutting tool, and directs the cuttings into the inner tube for discharge to the drilling surface. FIG. 15A illustrates in detail the flow of fluid and cuttings (represented by arrowed lines 340A and 340B, respectively) through the lower portion of the rotary and carriage assembly. FIG. 15A also clearly illustrates the preferred center cuttings discharge hose 340C which is adapted to convey cuttings from the inner tube of a tube-in-tube drill pipe (or tube-in-tube drill pipe string) to the cuttings discharge tube 370, which is described below.

Figure 16:
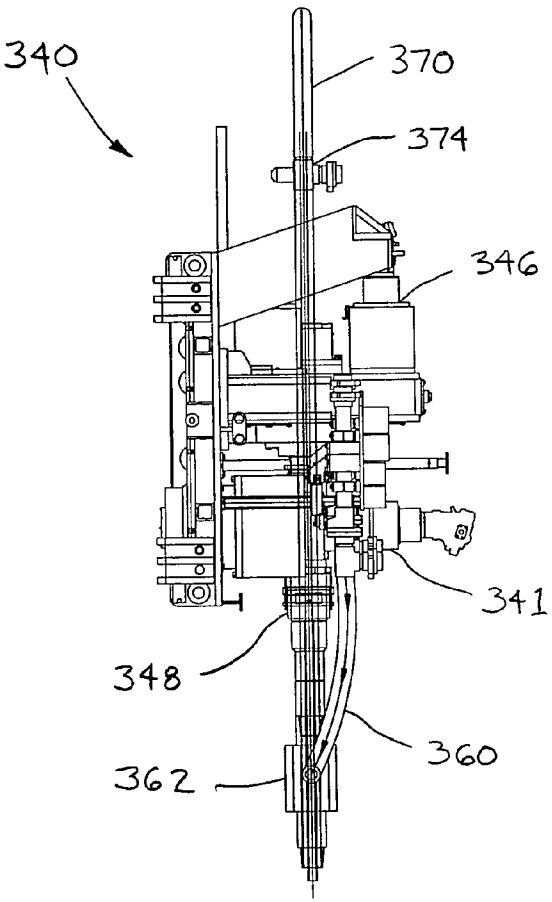
FIG. 16 is a side view of the alternative embodiment of the rotary and carriage assembly illustrated in FIGS. 15 and 15A.

As shown in FIGS. 15 and 16, the preferred rotary and carriage assembly 340 includes carriage drive planetary gearbox 341, rotary gearbox hydraulic motor 346, rotary gearbox output spindle 348 and telescoping slip spindle sub assembly 350. In addition, the preferred rotary and carriage assembly 340 includes plumbing adapted to convey fluid to the annular channel between the inner tube and the outer tube of a tube-in-tube drill pipe and/or a tube-in-tube drill pipe string. The preferred rotary and carriage assembly 340 includes plumbing adapted to convey cuttings from the inner tube of the tube-in-tube drill pipe out of the drilling assembly. More particularly, in the preferred rotary and carriage assembly, fluid inlet tube 360 is connected to below rotary side inlet swivel 362 such that fluid in conveyed to the annular channel between the inner tube and the outer tube of a tube-in-tube drill pipe. Preferably, an inlet hammer union 364 or some other suitable connection device is located at the upstream end of the fluid inlet tube. Also in the preferred rotary and carriage assembly, cuttings discharge tube 370 is connected to above rotary swivel 372 such that cuttings from the inner tube of the tube-in-tube drill pipe may be conveyed out of the assembly. The preferred discharge tube 370 also includes discharge hammer union 374 or some other suitable connecting device. While the preferred fluid inlet tube 360 and the preferred cuttings discharge tube 370 are illustrated in their preferred configuration and arrangement, it is contemplated within the scope of the invention that the tubes may be any suitable configuration and they may be located in any suitable arrangement.

In operation, several advantages of the apparatus and method of the invention are realized. For example, the drilling assembly of the invention produces an increased capacity for drill pipe rotational, thrust and pull-back forces. The drilling assembly of the invention is capable of producing longer well bores and well bores having a greater diameter than those produced by conventional drilling assemblies. The drilling assembly of the invention is capable of entering the earth and drilling a well bore at any angle between approximately parallel to a horizontal drilling surface to a 90° vertical angle. Consequently, the drilling assembly of the invention is capable of drilling at an angle steeper than conventional horizontal directional drill assemblies and at an angle closer to horizontal than conventional vertical drill assemblies. The anchoring system and rotary and carriage assembly of the preferred drilling assembly of the invention eliminate the need for heavy drill pipe or drill collars in order to exert downward force on the drill bit. The drilling assembly of the invention is more easily transported than conventional drilling assemblies as a result of on-board power units and the reduced weight of the assembly. The rack and pinion rotary and carriage assembly of the drilling assembly of the invention eliminates the need for cables, winches, hydraulic cylinders, chain systems and the like to provide rotational, thrust and pull-back forces. The slip assembly of the preferred drilling assembly of the invention also reduces damage and wear to the threaded end of a drill string section when the top drive or rotary table engages the threaded end of the drill string section. The drilling assembly of the invention further reduces the amount of time required to perform make-up and break-out operations on the drill pipe and/or casing tool joints. The arms of the pipe and casing handler of the invention, which are pinned to the sub-structure, allow for easy removal during transport. The drilling assembly of the invention is also adapted to perform vertical and horizontal directional drilling applications with a tube-in-tube drill pipe and a tube-in-tube drill pip string. In addition, in the event of a power unit failure, the drilling assembly of the invention may continue to be operated as a result of the plurality of power units provided (run-on-one-technology).

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalence of the appended claims.

What is claimed is:

1. A modified horizontal directional drilling assembly for drilling pipe into a drilling surface, said drilling assembly comprising:

a power unit for supplying power to the drilling assembly;

a thrust frame adapted to be moved between a position substantially parallel to the drilling surface and a position substantially perpendicular to the drilling surface;

a means for moving the thrust frame;

a rotary and carriage assembly mounted on the thrust frame, said rotary and carriage assembly being adapted to apply rotational, thrust and pull-back forces to the drill pipe; and an anchoring system, said anchoring system comprising a tipping plate anchor, an anchor rod and an anchor hydraulic cylinder;

wherein the drilling assembly is adapted to drill pipe into the drilling surface in a substantially horizontal direction and at any angle relative to the drilling surface between substantially parallel to the drilling surface and substantially perpendicular to the drilling surface.

2. The drilling assembly of claim 1 wherein the power unit comprises at least two independent power units attached to the assembly.

3. The drilling assembly of claim 2 wherein the drilling assembly is adapted to operate at full capacity at half speed using one of said at least two independent power units in the event that one or more of the other of said at least two independent power units is not in operation.

4. The drilling assembly of claim 1 wherein the thrust frame is pivotally connected to the assembly.

5. The drilling assembly of claim 4 wherein the thrust frame is pivotally connected to the assembly by a dual hinge having at least two pivot points.

6. The drilling assembly of claim 1 wherein thrust frame is adapted to be moved through at least approximately 90° relative to the drilling surface.

7. The drilling assembly of claim 1 wherein the means for moving the thrust frame is a frame hydraulic cylinder.

8. The drilling assembly of claim 1 wherein the rotary and carriage assembly is a positive rack and pinion carriage system comprising:

a carriage drive planetary gearbox;

a carriage drive motor;

a rotary gearbox planetary gearbox;

a rotary gearbox hydraulic motor; and a telescoping slip spindle sub assembly.

9. The drilling assembly of claim 8 wherein the telescoping slip spindle sub assembly comprises:

a rotary gearbox output spindle;

a drive sleeve;

a housing;

a slip spindle input end; and a slip spindle output end.

10. The drilling assembly of claim 1 further comprising a break out wrench assembly.

11. The drilling assembly of claim 1 further comprising a drill pipe guide bushing assembly.

12. The drilling assembly of claim 1 further comprising a sub-structure.

13. The drilling assembly of claim 12 further comprising a leveling jack mounted to the sub-structure.

14. The drilling assembly of claim 1 further comprising a casing slip assembly.

15. The drilling assembly of claim 12 further comprising a drill pipe and casing handler and a means for moving the drill pipe and casing handler.

16. The drilling assembly of claim 15 wherein the drill pipe and casing handler is removably connected to the sub-structure by a pin connection.

17. The drilling assembly of claim 16 wherein the means for moving the drill pipe and casing handler is a hydraulic actuator.

18. The drilling assembly of claim 1 further comprising a wide strut system.

19. A method for drilling pipe into a drilling surface; said method comprising:

providing a modified horizontal directional drilling assembly, said drilling assembly comprising:

a power unit for supplying power to the drilling assembly;

a thrust frame adapted to be moved between a position substantially parallel to the drilling surface and a position substantially perpendicular to the drilling surface;

a means for moving the thrust frame;

a rotary and carriage assembly mounted on the thrust frame, said rotary and carriage assembly being adapted to apply rotational, thrust and pull-back forces to the drill pipe; and an anchoring system, said anchoring system comprising a tipping plate anchor, an anchor rod and an anchor hydraulic cylinder;

wherein the drilling assembly is adapted to drill pipe into the drilling surface in a substantially horizontal direction and at any angle relative to the drilling surface between substantially parallel to the drilling surface and substantially perpendicular to the drilling surface;

placing a drill pipe onto the drilling assembly;

moving the thrust frame to a desired drilling angle;

moving the rotary and carriage assembly into direct contact with the drill pipe;

applying rotational, thrust and pull-back forces to the drill pipe; and drilling the pipe into the drilling surface.

20. The method of claim 19 further comprising the step of anchoring the assembly.

21. The method of claim 19 further comprising the step of leveling the assembly.

* * * * *